US006979523B1

(12) United States Patent
Landa et al.

(10) Patent No.: US 6,979,523 B1
(45) Date of Patent: Dec. 27, 2005

(54) TONER MATERIAL AND METHOD UTILIZING SAME

(75) Inventors: Benzion Landa, Nes-Ziona (IL); Galia Golodetz, Rehovot (IL); Albert Teishev, Rishon-Lezion (IL); Peretz Ben-Avraham, Rehovot (IL); Becky Bossidan, Rishon-Lezion (IL)

(73) Assignee: Hewlett-Packard Development Company, LP, Houston, TX (US)

( * ) Notice: Subject to any disclaimer, the term of this patent is extended or adjusted under 35 U.S.C. 154(b) by 0 days.

(21) Appl. No.: 09/322,174

(22) Filed: May 28, 1999

Related U.S. Application Data

(62) Division of application No. 08/930,430, filed as application No. PCT/NL95/00193 on Jun. 6, 1995, now Pat. No. 5,908,729.

(30) Foreign Application Priority Data

Apr. 1, 1995 (IL) ..... 113302

(51) Int. Cl.[7] ..... G03G 9/00
(52) U.S. Cl. ..... 430/109.1; 430/114
(58) Field of Search ..... 430/114, 109.1, 430/110.1, 108.1, 10.1; 428/328; 106/1.19

(56) References Cited

U.S. PATENT DOCUMENTS

| | | | | | |
|---|---|---|---|---|---|
| 3,843,571 | A | * | 10/1974 | Fitzgerald | 260/17 |
| 4,284,700 | A | * | 8/1981 | Oguchi et al. | 430/105 |
| 4,355,055 | A | * | 10/1982 | Beske et al. | 427/97.5 |
| 4,794,651 | A | | 12/1988 | Landa et al. | 430/110 |
| 4,925,763 | A | * | 5/1990 | Tsubuko et al. | 430/106 |
| 4,985,732 | A | | 1/1991 | Landa et al. | 355/256 |
| 5,047,808 | A | | 9/1991 | Landa et al. | 355/277 |
| 5,089,362 | A | * | 2/1992 | Chou et al. | 430/16 |
| 5,089,856 | A | | 2/1992 | Landa et al. | 355/279 |
| 5,117,263 | A | | 5/1992 | Adam et al. | 355/256 |
| 5,142,337 | A | | 8/1992 | Karidis et al. | 355/266 |
| 5,150,161 | A | | 9/1992 | Bujese | |
| 5,166,734 | A | | 11/1992 | Pinhas et al. | 355/273 |
| 5,176,980 | A | | 1/1993 | Santilli et al. | 430/137 |
| 5,180,650 | A | | 1/1993 | Sacripante et al. | 430/106.6 |
| 5,184,183 | A | | 2/1993 | Karidis et al. | 355/266 |
| 5,280,326 | A | | 1/1994 | Pinhas et al. | 355/273 |
| 5,281,505 | A | * | 1/1994 | Inoue et al. | 430/108.3 |
| 5,289,238 | A | | 2/1994 | Lior et al. | 355/256 |
| 5,322,751 | A | * | 6/1994 | Chou et al. | 430/32 |
| 5,330,868 | A | | 7/1994 | Santilli et al. | 430/106 |
| 5,346,796 | A | | 9/1994 | Almog | 430/115 |
| 5,394,232 | A | | 2/1995 | Tamura et al. | 355/327 |
| 5,508,790 | A | | 4/1996 | Belinkov et al. | 355/211 |
| 5,568,235 | A | | 10/1996 | Amarakoon | 355/256 |
| 5,636,349 | A | | 6/1997 | Landa et al. | 399/307 |
| 5,655,192 | A | | 8/1997 | Denton et al. | 399/240 |
| 5,670,251 | A | * | 9/1997 | Difrancesco | 428/325 |
| 5,753,392 | A | * | 5/1998 | Ray et al. | 430/45 |
| 6,153,348 | A | * | 11/2000 | Kydd et al. | 430/119 |
| 6,376,147 | B1 | * | 4/2002 | Bonsignore et al. | 430/114 |

FOREIGN PATENT DOCUMENTS

| | | | | |
|---|---|---|---|---|
| CA | 709347 | * | 5/1965 | 430/114 |
| EP | 0 184 714 | | 6/1986 | |
| JP | 62100771 | * | 5/1987 | |
| JP | 1112254 | * | 4/1989 | |
| JP | 5-100525 | | 4/1993 | |
| JP | 5-100579 | | 4/1993 | |
| JP | 5-503166 | | 5/1993 | |
| JP | 05-24271 | | 9/1993 | |
| JP | 05-242721 | * | 9/1993 | |
| JP | 6-348066 | | 12/1994 | |
| WO | 9014619 | | 11/1990 | |
| WO | WO 92/10793 | | 6/1992 | |
| WO | 9213297 | | 8/1992 | |
| WO | 9402887 | | 2/1994 | |
| ZA | 85/9359 | | 12/1985 | |

OTHER PUBLICATIONS

Database WPI; Section Ch, Week 199342; Derwent Publications Ltd, London, GB; AN 1993-332422; XP002168236; & JP 05-242721 (Nec Corp.); Sep. 21, 1993; Abstract.
Database WPI, Section Ch, Week 19922; Derwent Publications Ltd., London, GB; AN 1992-178073; XP002168308; & JP 04-101156 (Nec Corp.); Apr. 2, 1992; Abstract.
Database WPI; Section Ch, Week 198135; Derwent Publications Ltd., London, GB; AN 1981-63055D; XP002168237; & JP 56-084770 (Nippon Paint Co. Ltd.); Jul. 10, 1981; Abstract.
Databse WPI; Section Ch, Week 199435; Derwent Publications Ltd., London, GB; AN 1994-283941; XP002168238; & JP 62-127753 (Mita Kogyo KK); Jun. 10, 1987; Abstract.
Databse WPI; Section Ch, Week 199123; Derwent Publications Ltd., London, GB; AN 1991-169234; XP002168239; & JP 03-103865 (Toppan Printing Co. Ltd.); Apr. 30, 1991; Abstract.
Databse WPI; Section Ch, Week 198629; Derwent Publications Ltd., London, GB; AN 1986-186087; XP002168240; & JP 61-118461 (Toyo Aluminium KK); Jun. 5, 1986; Abstract.
Databse WPI; Section Ch, Week 199232; Derwent Publications Ltd., London, GB; AN 1992-265728; XP002168241; & JP 04-183804 (Pentel KK); Jun. 30, 1992; Abstract.

* cited by examiner

*Primary Examiner*—John L Goodrow

(57) ABSTRACT

A toner particle adapted for use in electrostatic image formation, comprising a polymer and flakes of metal dispersed in the polymer.

12 Claims, 2 Drawing Sheets

TONER MATERIAL AND METHOD UTILIZING SAME

CROSS-REFERENCE TO RELATED APPLICATIONS

This application is a divisional of application Ser. No. 08/930,430, Jun. 6, 1995 now U.S. Pat. No. 5,908,729, which is the U.S. National Stage of International Application No. PCT/NL95/00193, filed Jun. 6, 1995, and claims priority of Israeli Application No. 113,302, filed Apr. 7, 1995. The entire disclosure of Application No. 08/930,430 is considered as being part of the disclosure of this application, and the entire disclosure of application Ser. No. 08/930,430 is expressly incorporated by reference herein in its entirety.

FIELD OF THE INVENTION

The present invention relates to improved electrostatic processes for printing or coating on polymer films and surfaces with toner and toner inks. The invention specifically relates to a method of achieving high quality high contrast colored or multi-colored images in continuous roll printing on transparent, flexible packaging films.

BACKGROUND OF THE INVENTION

The coating of plastic films or surfaces e.g. polyethylene, polypropylene, etc. for aesthetic or functional purposes is of great utility and importance. A major use of such films is in food packaging.

Electrostatic painting has inherent advantages which would appear to make it particularly desirable for printing on plastic films. The inherent advantages include adaptability to short runs economically, high resolution, on demand printing and good visibility. However, at present, printing on transparent films, especially multi-color printing is commercially performed in multi-head presses, and only in long runs.

SUMMARY OF THE INVENTION

It is an object of certain aspects of the present invention to produce improved quality color images electrostatically on transparent plastic films and substrates.

Color integrity of multi-color images is improved by optimizing the image forming and transfer stages of the printing process.

In order to improve the visibility of color images printed on the inner surface of transparent flexible packaging, according to a preferred embodiment of the invention, the color image is overcoated with a substantially opaque toner layer at least in those portions of the packaging which are printed with color toners. Thus on the packaging material, at least one color toner layer is situated closest to the material, and a white or other opaque layer is situated behind the colored layer or layers, i.e., further away from the material. Such images are viewed from the unprinted side of the substrate.

Alternatively, the complete multi-layer image is printed with the opaque layer uppermost on the intermediate transfer member so that, when the image is transferred to the substrate, the opaque layer is closest to the substrate. Such images are viewed from the printed side of the substrate.

Additionally, the white toner layer may also extend past the edges of the colored layers and directly contact the packaging material.

In order to avoid unnecessary alignment and registration steps, the different color images involved are sequentially transferred from an image forming surface onto an intermediate transfer member, each in alignment with previous images. The intermediate transfer member is heated so that each color image coalesces into a cohesive film, in which the respective color pigments are held so that they do not diffuse into other layers. Mixing of colors, especially with the opaque pigment is detrimental to image quality.

Each complete multi-color image is subsequently transferred from the intermediate transfer member to the substrate.

Another object of certain aspects of the present invention is to provide a process for printing toner polymer images on ionomer (high or low molecular weight) or ethylene vinyl acetate coatings on polymer surfaces, thereby achieving improved qualities. The toner polymer images may be based on high molecular weight ionomers, e.g. Surlyns, low molecular weight ionomers, e.g. Aclyns, ionomers having an intermediate molecular weight, ethylene vinyl acetate polymers and ethelene copolymers or terpolymers e.g., Bynels and Nucrels, to achieve improved qualities, such as sealability, adhesiveness, food compatibility, and others.

In other aspects of the invention special toners, including opaque white, silver, gold and fluorescent toners have been prepared by adding pigments to a hot ionomer solution, preferably of low molecular weight ionomers, and stirring the mixture as it cools. This procedure has been used to prepare gold, silver, white opaque $TiO_2$ based, magnetic and fluorescent inks, respectively.

There is thus provided, in accordance with a preferred embodiment of the invention, a printing process for forming high contrast color images on polymer surfaces, comprising:

(a) forming a layer of substantially opaque liquid toner comprising polymer based toner particles and a carrier liquid, on an imaging surface;

(b) transferring the layer to an intermediate transfer member;

(c) heating the layer on the intermediate transfer member to a temperature at which the toner particles at least partially coalesce;

(d) repeating (a) to (c) sequentially for at least one subsequent layer in at least one color in image form, said at least one subsequent layer being transferred to the intermediate transfer member onto the opaque layer to form multiple layers on the intermediate transfer member; and (e) transferring the multiple layers to a polymer surface of a transparent substrate.

There is further provided, in accordance with a preferred embodiment of the invention, a printing process for forming high contrast color images on polymer surfaces, comprising:

(a) forming a colored layer of liquid toner in image form comprising polymer based toner particles and a carrier liquid, on an imaging surface;

(b) transferring the layer to an intermediate transfer member;

(c) heating the layer on the intermediate transfer member to a temperature at which the toner particles at least partially coalesce;

(d) repeating (a) to (c) sequentially for at least a substantially opaque liquid toner layer, said substantially opaque layer being transferred to the intermediate transfer member onto the colored layer to a plurality of layers on the intermediate transfer member; and (e) transferring the plurality of layers to a polymer surface.

Preferably, forming a layer comprises:

(i) charging a photoreceptor surface;

(ii) selectively discharging portions of the charged photoreceptor surface to form a predefined electrostatic image; and (iii) developing a layer of charged opaque white toner particles onto the selectively discharged portions of the photoreceptor surface thereby providing a developed image corresponding to the latent image.

There is further provided, in accordance with a preferred embodiment of the invention, a printing process comprising:

(a) forming a liquid toner image comprising toner particles based on a first polymer and a carrier liquid, on an imaging surface;

(b) transferring the image to a surface coated with a second polymer; and (c) fusing and fixing the image to the surface coating, wherein the second polymer is either an ionomer or an ethylene vinyl acetate polymer.

Preferably, the second polymer is either an ionomer or an ethylene vinyl acetate polymer high molecular weight ionomers, e.g. Surlyns, low molecular weight ionomers, e.g. Aclyne, ionomers having an intermediate molecular weight, ethylene vinyl acetate polymers and ethelene copolymers or terpolymers e.g., Bynels and Nucrels.

There is further provided, in accordance with a preferred embodiment of the invention, a printing process comprising:

(a) forming a liquid toner image comprising toner particles based on a first polymer and a carrier liquid, on an imaging surface;

(b) transferring the image to a surface coated wish a second polymer; and (c) fusing and fixing the image to the surface coating, wherein the first and second polymer is an ionomer.

Preferably, the first polymer is comprises an ionomer, more preferably the same ionomer as the second polymer.

There is further provided, in accordance with a preferred embodiment of the invention, a toner particle comprising:

a polymer; and flakes of metal dispersed in the polymer.

Preferably, the flakes which may be of gold or silver, have a dimension greater than about 4 micrometers, more preferably than 6 micrometers.

There is further provided, in accordance with a preferred embodiment of the invention, a toner particle comprising:

a polymer; and a particulate fluorescent material, preferably in the form of particles having a size greater than 2 micrometers dispersed in the polymer. As used herein the term "particulate fluorescent material" does not include a dyed polymer.

Preferably, the polymer in the above toner particles is a low molecular weight ionomer.

It is, of course, understood that black toner is not suitable for a backing material for a transparent image film since it will result in substantially no image being observed. Thus, to be useful for the present invention should not be made of a completely light absorbing material.

BRIEF DESCRIPTION OF THE DRAWINGS

The invention will be more clearly understood from the following description of preferred embodiments thereof in conjunction with the following drawings which.

DETAILED DESCRIPTION OF PREFERRED EMBODIMENTS

Figure 1:
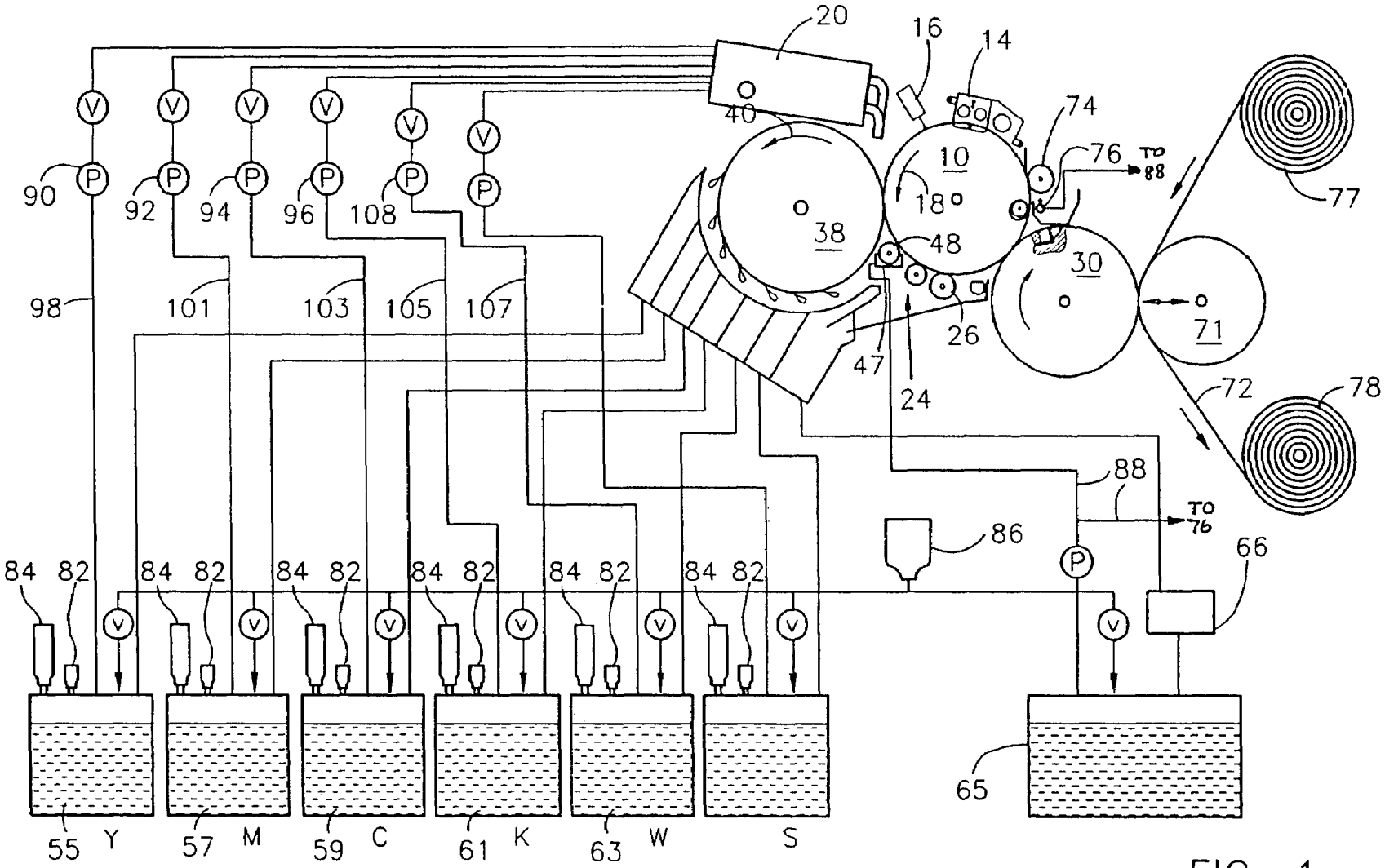
FIG. 1 is a simplified sectional illustration of electrostatic imaging apparatus constructed and operative in accordance with a preferred embodiment of the present invention.
Figure 2:
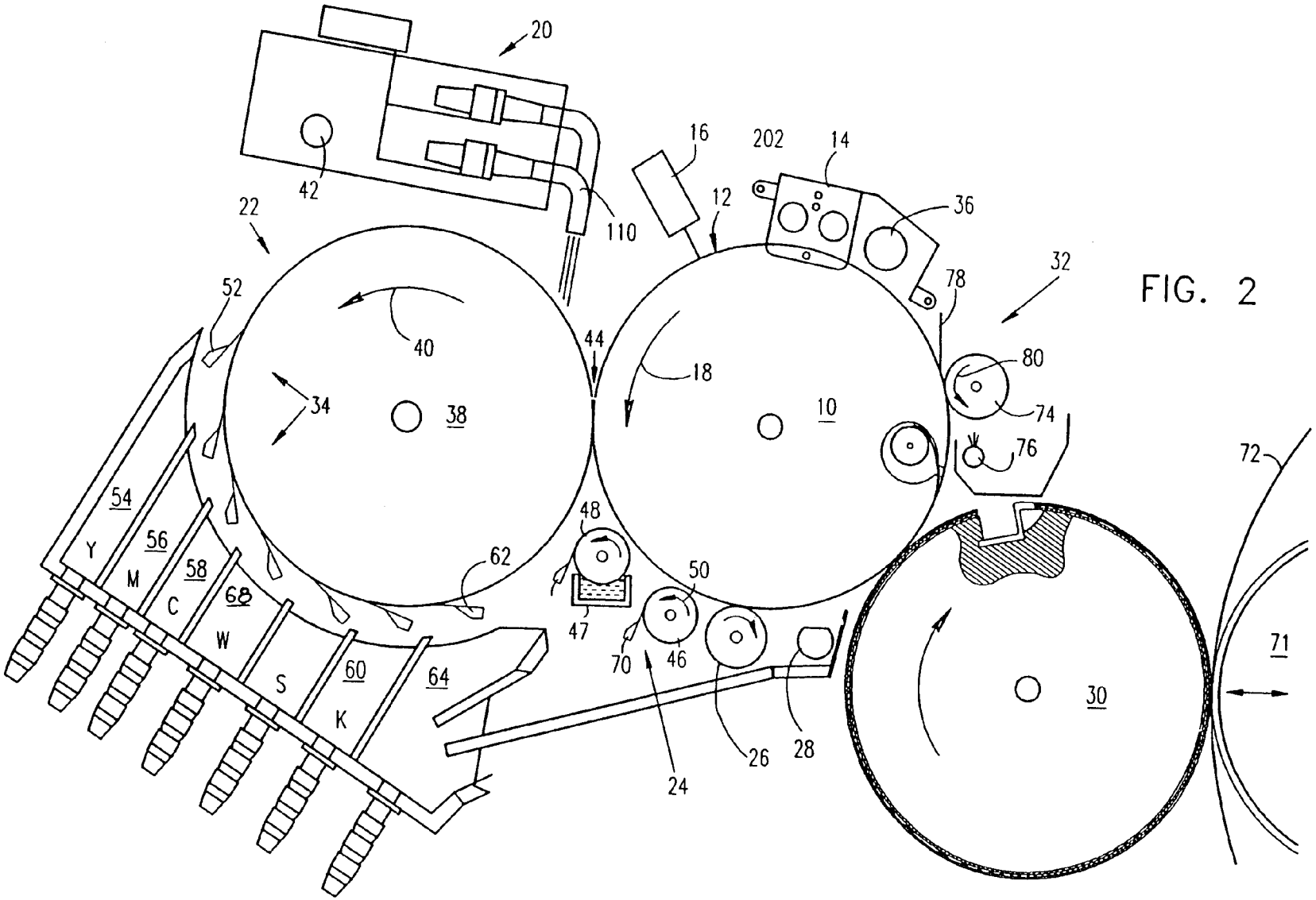
FIG. 2 is a simplified enlarged sectional illustration of the apparatus of FIG. 1.

Reference is now made to FIGS. 1 and 2 which illustrate a multi color electrostatic imaging system constructed and operative in accordance with a preferred embodiment of the present invention. As seen in FIGS. 1 and 2 there is provided an imaging sheet, preferably an organic photoreceptor 12, typically mounted on a rotating drum 10. Drum 10 is rotated about its axis by a motor or the like (not shown), in the direction of arrow 18, past charging apparatus 14, preferably a corotron, scorotron or roller charger or other suitable charging apparatus as are known in the art and which is adapted to charge the surface of sheet photoreceptor 12. The image to be reproduced is focused by an imager 16 upon the charged surface 12 at least partially discharging the photoconductor in the areas struck by light, thereby forming an electrostatic latent image. Thus, the latent image normally includes image areas at a first electrical potential and background areas at another electrical potential.

A preferred photoreceptor sheet and preferred methods of mounting it on drum 10 are described in a co-pending application of Belinkov et al., IMAGING APPARATUS AND PHOTORECEPTOR THEREFOR, filed Sep. 7, 1994 assigned Ser. No. 08/301,775 now U.S. Pat. No. 5,508,790 and in corresponding applications in other countries, the disclosures of which are incorporated herein by reference. Alternatively, photoreceptor 12 may be deposited on the drum 10 and may form a continuous surface. Furthermore, photoreceptor 12 may be a non-organic type photoconductor based, for example, on a compound of selenium.

Also associated with drum 10 and photoreceptor sheet 12, in a preferred embodiment of the invention, are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36. Developing assembly 22 preferably includes a development roller 38. Development roller 38 is preferably spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

In accordance with a preferred embodiment of the invention, an opaque, white background image is initially developed on the photoreceptor surface and transferred to an intermediate transfer member 30. The background image is heated to a temperature that causes the white toner particles in the presence of carrier liquid to at least partially coalesce, preferably into a cohesive film, i.e., the toner pigment is fixed in the layer in which it was deposited so that mixing of different color pigments in various layers is prevented. This is essential for the achievement of good color quality and contrast in the final composite image. Subsequent images in different colors are individually developed and sequentially transferred in alignment with the previous image onto intermediate transfer member 30, which is heated as before so that each color forms a cohesive non-diffusive layer.

It should be noted that each of the layers is a viscous liquid and that while heating does cause the layers to coalesce, the balance between viscosity and surface tension of the layers is apparently such that the individual layers have only minimal mixing.

When all of the desired images have been transferred to intermediate transfer member 30, the complete multi-color image is transferred therefrom to substrate 72. Impression roller 71 only produces operative engagement between intermediate transfer member 30 and substrate 72 when transfer of the composite image to substrate 72 takes place, preferably with heat and pressure. Substrate 72 which is preferably a transparent flexible polymer film is fed from a feeder roller 77 and is taken up by take up roller 78. The printing process when carried out as described produces a high contrast high colored quality image.

Preferably, the motion of the polymer film is halted during the accumulation of the layers on the intermediate transfer member. Just prior to the transfer, the film is accelerated to a velocity substantially equal to the surface velocity of the intermediate transfer member, such that there is substantially zero relative motion between them at the time of contact. Furthermore, between transfers, the film is preferably partially rewound so that, after the acceleration, only a minimal blank space is left unprinted.

Multicolor liquid developer spray assembly 20, whose operation and structure is described in detail in U.S. Pat. No. 5,117,263, the disclosure of which is incorporated herein by reference, may be mounted on axis 42 to allow assembly 20 to be pivoted in such a manner that a spray of liquid toner containing electrically charged pigmented toner particles can be directed either onto a portion of the development roller 38, a portion of the photoreceptor 12 or directly into a development region 44 between photoreceptor 12 and development roller 38. Alternatively, assembly 20 may be fixed. Preferably, the spray is directed onto a portion of the development roller 38.

Color specific cleaning blade assemblies 34 are operatively associated with developer roller for separate removal of residual amounts of each colored toner remaining thereon after development. Each of blade assemblies 34 is selectably brought into operative association with developer roller 38 only when toner of a color corresponding thereto is supplied to development region 44 by spray assembly 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 which serves to direct the toner removed by the cleaning blade assemblies 34 from the developer roller 38 to separate collection containers 54, 56, 58, 60, and 68 and for each color to prevent contamination of the various developers by mixing of the colors. The toner collected by the collection containers is recycled to a corresponding toner reservoir (55, 57, 59, 61 and 63). And a final toner directing member 62 always engages the developer roller 38 and the toner collected thereat is supplied into collection container 64 and thereafter to reservoir 65 via separator 66 which is operative to separate relatively clean-carrier liquid from the various colored toner particles. The separator 66 may be typically of the type described in U.S. Pat. No. 4,985,732, the disclosure of which is incorporated herein by reference.

In a preferred embodiment of the invention, as described in PCT Publication WO 92/13297, the disclosure of which is incorporated herein by reference, where the imaging speed is very high, a background cleaning station 24 typically including a reverse roller 46 and a wetting roller 48 is provided. Reverse roller 46 which rotates in a direction indicated by arrow 50 is preferably electrically biased to a potential intermediate that of the image and background areas of photoconductive drum 10, but different from that of the development roller. Reverse roller 46 is preferably spaced apart from photoreceptor sheet 12 thereby forming a gap therebetween which is typically 40 to 150 micrometers.

Wetting roller 48 is preferably partly immersed in a fluid bath 47, which preferably contains carrier liquid received from carrier liquid reservoir 65 via conduit 88. Wetting roller 48, which preferably rotates in the same sense as that of drum 10 and reverse roller 46, operates to wet photoreceptor sheet 12 with non-pigmented carrier liquid upstream of reverse roller 46. The liquid supplied by wetting roller 48 replaces the liquid removed from drum 10 by development assembly 22, thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via collection container 64 and separator 66.

Wetting roller 48 is preferably electrically biased to a potential intermediate that of the image and background areas of photoconductive drum 10, but different from that of the development roller. This biasing of wetting roller 48 assists in removing toner particles from the background areas of photoreceptor sheet 12. Wetting roller 48 is preferably spaced apart from photoreceptor sheet 12 thereby forming a gap therebetween which is typically 40 to 200 micrometers.

The apparatus embodied in reference numerals 46, 47, 48 and 70 is generally not required for low speed systems, but is preferably included in high speed systems.

Preferably, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles.

Discharge device 28 is operative to flood sheet 12 with light which discharges the voltage remaining on sheet 12, mainly to reduce electrical breakdown and improve transfer of the image to intermediate transfer member 30. Operation of such a device in a write black system is described in U.S. Pat. No. 5,280,326, the disclosure of which is incorporated herein by reference.

FIGS. 1 and 2 further show that multicolor toner spray assembly 20 receives separate supplies of colored toner typically from five different reservoirs 55, 57, 59, 61 and 63. FIG. 1 shows five different colored toner reservoirs 55, 57, 59, 61 and 63, typically containing the colors Yellow, Magenta, Cyan, black and white, respectively. In addition, reservoir 65 contains relatively clean carrier liquid whose operation was described. Pumps 90, 92, 94, 96 and 108, may be provided along respective supply conduits 98, 101, 103, 105, and 107, for providing a desired amount of pressure to feed the colored toner to multicolor spray assembly 20.

Alternatively, multicolor toner spray assembly 20, which is preferably a three level spray assembly, receives supplies of colored toner from up to six different reservoirs (a sixth reservoir marked S is shown) which allows for custom colored toners in addition to the standard process colors, black and white.

Toners that can be used with the present invention are described in Example 1 of U.S. Pat. No. 4,794,651, the disclosure of which is incorporated herein by reference or variants thereof as are well known in the art. For colored liquid developers, carbon black is replaced by color pigments as is well known in the art. Other toners may alternatively be employed, including liquid toners and, as indicated above, including powder toners.

Other toners for use in the invention can be prepared using the following method:

1) Solubilizing 1400 grams of Nucrel 925 (ethylene copolymer by Dupont) and 1400 g of Isopar L (Exxon) are thoroughly mixed in an oil heated Ross Double Planetary Mixer at least 24 RPM for 1.5 hours, with the oil temperature at 130° C. 1200 g of preheated Isopar L is added and mixing is continued for an additional hour. The mixture is cooled to 45° C., while stirring is continued over a period of several hours, to form a viscous material.

2) Milling and Grinding 762 grams of the result of the Solubilizing step are ground in a 1S attritor (Union Process Inc. Akron Ohio), charged with 3/16" carbon steel balls at 250 RPM, together with 66.7 grams of Mogul L carbon black (Cabot), 6.7 grams of BT 583D (blue pigment produced by Cookson), 5 grams of aluminum stearate (Riedel Dehaen) and an additional 1459.6 grams of Isopar L for eight hours at 30° C.

3) Continuation of Grinding 34.5 grams of ACumist A-12 (a micronised polyethylene wax produced by Allied Signal) is added and grinding is continued for an additional 4 hours. The resulting particles are fibrous particles have a measured diameter in the range of 1–3 micrometers.

The resulting material is diluted with additional Isopar L and Marcol 82 to give a working developer in which the dry solids portion is about 1.7% and in which the overall ratio of Isopar L to Marcol is between about 50:1 and 500:1, more preferably between about 100:1 and 200:1. Charge director as described in U.S. patent application Ser. No. 07/915,291 (utilizing lecithin, BBP and ICIG3300B) and in WO 94/02887, in an amount approximately equal to 40 mg/gm of solids in the final dispersion, is added to charge the toner particles. Other charge directors and additional additives as are known in the art may also be used.

The above described process produces a black toner. Cyan, magenta and yellow toners can be produced by using a different mix of materials for step 2). For Cyan toner, 822 g of the solubilized material, 21.33 grams each of BT 583D and BT 788D pigments (Cookson), 1.73 grams of D1355DD pigment (BASF), 7.59 grams of aluminum stearate and 1426 grams of Isopar L are used in step 2. For Magenta toner, 810 grams of solubilized material, 48.3 grams of Finess Red F2B, 6.81 grams of aluminum stearate and 1434.2 grams of Isopar L are used in step 2. For yellow toner 810 grams of solubilized material, 49.1 grams of D1355DD pigment, 6.9 grams of aluminum stearate and 1423 grams of Isopar L are used in step 2.

Other preferred liquid toners for use in the present invention are prepared as follows: 300 grams of a chargeable low molecular weight ionomer Aclyn 293A (made by Allied Signal) were solubilized in 1500 grams of Isopar-L with heating to 110°–120° C. while stirring. To form inks, dispersed pigments or color particles are added to and mixed with the hot solubilized polymer. The composition is allowed to cool while stirring.

The following liquid toner inks were prepared in this way:

$TiO_2$ Based Opaque White Toner Ink

A preferred opaque white ink in accordance with the present invention is prepared by adding 200 grams of finely divided TiO2 pigment, having an average diameter of about 0.5 micrometers to the solubilized polymer while stirring. The mixture is allowed to cool and settle with continuous stirring. Charge director, as described above or other charged directors as known in the art, and additional Isopar L and MARCOL 82 carrier liquid are added to form a liquid toner. The opaque white liquid toner so obtained is used, as previously mentioned, to enhance the quality of color images when it serves as a back layer for color contrast. The median pigmented toner particle size in the toner is 4.81 micrometers.

An alternative preferred method for producing white toner ink concentrate, in accordance with a preferred embodiment of the invention comprises the steps of (1) plasticizing 35% Nucrel 699 (ethylene-metacrylic acid copolymer by DuPont) in Isopar L (EXXON) by heating the materials in a Ross double planetary mixer to 150° C. while mixing the materials and allowing the mixture to cool while mixing continues until the mixture is fully mixed and homogeneous; (2) mixing 3071 grams of the mixture produced by step (1) with 1075 grams of KRONOS 2310 titanium dioxide (NL Chemicals) and 4454 grams of Isopar L in a Ross type LAB ME high shear-mixer until the new mixture is completely homogeneous; and (3) grinding the mixture at about 56° C. (the temperature of the mixture without cooling) for 16 hours in a SEECO M18 Vibratory Mill charged with 3/8" zirconia media. The resultant toner has a median diameter of about 3 microns.

The material is charged and diluted as described above and 3 micrometer micron particles of TEFLON M1200 are optionally added to act as protective spacers against abrasion for the final image.

Other inks are prepared in a manner similar to the first method for producing white toner ink and provided the following results:

Gold Toner Ink

Aclyn293A, (made by Allied Signal) 150 grams, and Isopar-L, 800 grams, are heated with mixing in a glass beaker, at a temperature of 110°–120° C. 100 grams of 6–micrometer gold flakes (made by SCHLENK) are slowly added and mixing is continued for 5 minutes. The temperature is allowed to fall to 90° C.

The composition is mixed at high shear (ROSS HIGH SHEAR MIXER) for 1 minute and cooled, while mixing, to room temperature while mixing is continued at 250 RPM.

Final ink median particle size as measured by a SCHIMADZU PARTICLE SIZE ANALYZER is 18.6 micrometers.

The ink was tested in an E-PRINT 1000 (using the single final transfer mode described above and separate transfer of individual colors to the final substrates) printer (INDIGO, N.V.) giving metallic gold prints which are free of background contamination. It should be noted that this method of preparing gold ink (and the other inks described below), without grinding, results in large reflective gold particles being laid onto the subsrate. While the flakes are unaligned in the toner, when the toner is formed into a thin layer during heating and fixing to the substrate, the flakes selectively align themselves to give good specular reflection.

Silver Ink

The materials used in the preparation are 300 grams Aclyn293A (made by Allied Signal), 1500 grams Isopar-L and 100 Grams silver flakes 6–10 micrometers (made by SCHLENK). The same procedure as for gold ink is used to obtain ink with a median particle size of 8.2 micrometers.

The ink was tested in both printing modes, in the printer giving metallic silver prints without background contamination.

Magnetic Ink

The materials used in the preparation are 20 grams Aclyn293A (made by Allied Signal), 37 grams MO 4431 magnetic oxide (made by ISK MAGNETICS) with a particle size of 8–10 micrometers and 180 grams Isopar-L. The same procedure as for gold ink is used to obtain magnetic ink with a median particle size of 9.08 micrometers as measured by SCHIMADZU Particle Size Analyzer.

When the magnetic ink is deposited at a mass/area of 0.26 mg./sq.cm., the resultant layer has a magnetic signal of 82% of standard as measured by a NMI apparatus marketed by Checkmate Electronics, and an optical density of 1.5 (transmittance).

Fluorescent Ink

The materials used in the preparation are 500 grams Aclyn293A (made by Allied Signal), 333.3 grams fluorescent pigment RC15 (made by RADIANT COLOR) having a median article size of 2.5–4.5 micrometers and 1500 grams Isopar-L.

The resin is solubilized by the ISOPAR L in a ROSS DOUBLE PLANETARY MIXER heated at 110° C.

The pigment is predispersed and wetted by using a warm solution of Aclyn293A, then adding the predispersed pigment gradually into the double planetary mixer. The material is mixed for about 10 minutes, while heating is maintained, to obtain a homogeneous composition. Heating is stopped and mixing is continued for an additional 1.5 hours to obtain toner concentrate with a particle size of 3.82 micrometers. Working dispersions are prepared using a high shear mixer.

Intermediate transfer member 30 may be any suitable intermediate transfer member having a multilayered transfer portion such as those described below or in U.S. Pat. Nos. 5,089,856 or 5,047,808 or in U.S. patent application Ser. No. 08/371,117 now U.S. Pat. No. 5,745,829, filed Jan. 11, 1995 and entitled IMAGING APPARATUS AND INTERMEDIATE TRANSFER BLANKET THEREFOR (and in corresponding applications in other countries), the disclosures of which are incorporated herein by reference. Member 30 is maintained at a suitable voltage and temperature for electrostatic transfer of the image thereto from the image bearing surface. Intermediate transfer member is preferably associated with a pressure roller 71 for transfer of the image onto a final substrate 72, preferably by heat and pressure. Additionally, pressure roller 71 may be electrified to overcome the voltage on the intermediate transfer member or to provide an additional electric field to aid transfer of the electrified toner to the substrate.

Cleaning apparatus 32 is operative to scrub clean the surface of photoreceptor 12 and preferably includes a cleaning roller 74, a sprayer 76 to spray a non-polar cleaning liquid to assist in the scrubbing process and a wiper blade 78 to complete the cleaning of the photoconductive surface. Cleaning roller 74, which may be formed of any synthetic resin known in the art, for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

While the invention has been described with respect to printing on the inside of clear wrapping material (i.e., with the opaque layer furthest from the substrate), in an alternative preferred embodiment of the invention, the layer closest to the substrate is opaque. Such images are designed to be viewed from the side of the substrate on which the image is printed. For this embodiment of the invention, the white layer will be formed on the imaging surface and transferred to the intermediate transfer member after the other, colored layers.

In addition to the details of the printing processes given above, additional details of printing processes and operates are given in the patents and publications incorporated herein by reference.

It has been found that the above mentioned toners and other toners based on similar materials and high molecular weight ionomers such as surlyns adhere well to the substrates used in food packaging. This adhesion is found to be especially good when the toner is based on an ionomer or ethylene polymer or copolymer and the polymer film is coated by a similar material. Such coatings, particularly Surlyn 1601 ionomer, EVA (particularly low molecular weight EVA) and ethylene acrylic acid are often provided on the inner surface of food wrappings to give improved properties such as sealability, adhesiveness and food compatibility.

It should be understood that the invention is not limited to the specific type of image forming system used and the present invention is also useful with any suitable imaging system which forms a liquid toner image on an image forming surface and, the specific details given above for the image forming system are included as part of a best mode of carrying out the invention, however, many aspects of the invention are applicable a wide range of systems as known in the art for electrostatic printing and copying.

It will be appreciated by persons skilled in the art that the present invention is not limited by the description and example provided hereinabove. Rather, the scope of this invention is defined only by the claims which follow:

Which is claimed is:

1. A toner particle adapted for use in electrostatic image formation comprising:

a polymer, wherein the polymer is a low molecular weight ionomer; and flakes of gold or silver dispersed in the polymer, wherein the flakes of gold or silver have a dimension greater than 4 micrometers.

2. A toner particle according to claim 1, wherein flakes of gold are dispersed in the polymer.

3. A toner particle to claim 1, wherein flakes of silver are dispersed in the polymer.

4. A liquid toner comprising: a plurality of toner particles adapted for use in electrostatic image formation comprising; a polymer; and flakes of gold or silver dispersed in the polymer, wherein the flakes of gold or silver have a dimension greater than 4 micrometers; and a carrier liquid.

5. A liquid toner according to claim 4, wherein flakes of gold are dispersed in the polymer.

6. A liquid toner according to claim 4, wherein flakes of silver are dispersed in the polymer.

7. A method of printing utilizing a liquid toner according to claim 4.

8. A method of printing utilizing a liquid toner according to claim 5.

9. A method of printing utilizing a liquid toner according to claim 6.

10. A liquid toner according to claim 4 wherein the particles have a median particle size of between 8.2 and 18.6 microns.

11. A toner particle according to claim 1 wherein the flakes of gold or silver have a dimension greater than 6 micrometers.

12. A toner particle according to claim 4 wherein the flakes of gold or silver have a dimension greater than 6 micrometers.

* * * * *

UNITED STATES PATENT AND TRADEMARK OFFICE

CERTIFICATE OF CORRECTION

PATENT NO. : 6,979,523 B1
APPLICATION NO. : 09/322174
DATED : December 27, 2005
INVENTOR(S) : Benzion Landa et al.

It is certified that error appears in the above-identified patent and that said Letters Patent is hereby corrected as shown below:

On the title page, item (75), in "Inventors", in column 1, line 3, delete "Teishev" and insert -- Teisheb --, therefor.

On the title page, item (73), in "Assignee", in column 1, line 2, delete "LP" and insert -- L.P. --, therefor.

In column 1, line 32, delete "painting" and insert -- printing --, therefor.

In column 3, line 23, delete "Aclyne" and insert -- Aclyns --, therefor.

In column 3, line 31, delete "wish" and insert -- with --, therefor.

In column 5, line 43, after "roller" insert -- 38 --.

In column 8, line 48, delete "6-micrometer" and insert -- 6-10 micrometer --, therefor.

In column 9, line 30, delete "article" and insert -- particle --, therefor.

In column 10, line 40, after "applicable" insert -- to --.

In column 10, line 57, in Claim 3, after "particle" insert -- according --.

In column 10, line 60, in Claim 4, delete "comprising;" and insert -- comprising: --, therefor.

Signed and Sealed this

Twenty-second Day of December, 2009

David J. Kappos

David J. Kappos
*Director of the United States Patent and Trademark Office*